US006538394B2

(12) United States Patent
Volk et al.

(10) Patent No.: US 6,538,394 B2
(45) Date of Patent: Mar. 25, 2003

(54) CURRENT SOURCE METHODS AND APPARATUS FOR LIGHT EMITTING DIODES

(75) Inventors: Karl Richard Volk, Scotts Valley, CA (US); Andrew J. Mrizek, San Jose, CA (US); Gary Hurtz, Pleasanton, CA (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 0 days.

(21) Appl. No.: 09/822,620

(22) Filed: Mar. 30, 2001

(65) Prior Publication Data

US 2002/0140378 A1 Oct. 3, 2002

(51) Int. Cl.[7] ..... G05F 1/00
(52) U.S. Cl. ..... 315/291; 315/307; 362/800
(58) Field of Search ..... 315/291, 299, 315/300, 301, 302, 307, 309; 361/103; 362/800

(56) References Cited

U.S. PATENT DOCUMENTS 5,025,204 A * 6/1991 Su ..... 323/273
5,144,117 A * 9/1992 Hasegawa et al. ..... 362/800
5,218,364 A * 6/1993 Kumazawa et al. ..... 341/136
5,512,814 A 4/1996 Allman ..... 323/267
5,805,401 A 9/1998 Schuellein et al. ..... 361/92
6,016,050 A 1/2000 Brokaw ..... 323/315
6,111,367 A * 8/2000 Asano et al. ..... 315/291
6,161,910 A * 12/2000 Reisenauer et al. ..... 315/309
6,351,079 B1 * 2/2002 Willis ..... 315/200 A

FOREIGN PATENT DOCUMENTS

JP 144645 * 5/2000
WO WO 95/12300 4/1995

* cited by examiner

*Primary Examiner*—Don Wong
*Assistant Examiner*—Thuy Vinh Tran
(74) *Attorney, Agent, or Firm*—Blakely, Sokoloff, Taylor & Zafman LLP

(57) ABSTRACT

Current source methods and apparatus for light emitting diodes providing constant diode current and illumination in the presence of voltage and process variations. The method comprises providing a predetermined current through a first transistor, and mirroring the current through the first transistor to at least one additional transistor while holding the voltage across the first transistor to a predetermined value, wherein each additional transistor is coupled in series with a light emitting diode. An exemplary circuit, as well as various illustrative applications are disclosed.

23 Claims, 2 Drawing Sheets

CURRENT SOURCE METHODS AND APPARATUS FOR LIGHT EMITTING DIODES

BACKGROUND OF THE INVENTION

1. Field of the Invention

The present invention relates to the field of light emitting diode drive circuits.

2. Prior Art

Light emitting diodes are used in many applications to light displays or buttons, such as on cell phones, pagers, computers, etc. In such applications, it is desirable to have a constant illumination when using one or multiple diodes. The brightness of a light emitting diode depends upon the current flowing through the diode. Diodes are conventionally biased through a series resistor from a regulated voltage supply. The problem associated with this technique is that the amount of current through the diode depends significantly upon the forward voltage drop of the diode, which varies with size, process, temperature and aging. The present invention is directed to methods and apparatus for providing a predetermined current to such diodes in spite of these variations.

BRIEF SUMMARY OF THE INVENTION

Current source methods and apparatus for light emitting diodes providing constant diode current and illumination in the presence of voltage and process variations. The method comprises providing a predetermined current through a first transistor, and mirroring the current through the first transistor to at least one additional transistor while holding the voltage across the first transistor to a predetermined value, wherein each additional transistor is coupled in series with a light emitting diode. An exemplary circuit, as well as various illustrative applications are disclosed.

DETAILED DESCRIPTION OF THE PREFERRED EMBODIMENT

The present invention current source methods and apparatus for light emitting diodes is ideally suited for use in battery operated systems, particularly those using white light emitting diodes used for lighting buttons, displays and the like on hand held, laptop and similar devices. Consequently for purposes of illustration and not for purposes of limitation, the exemplary embodiments of the invention are described in a manner consistent with such use, though clearly the invention is not so limited.

Figure 1:
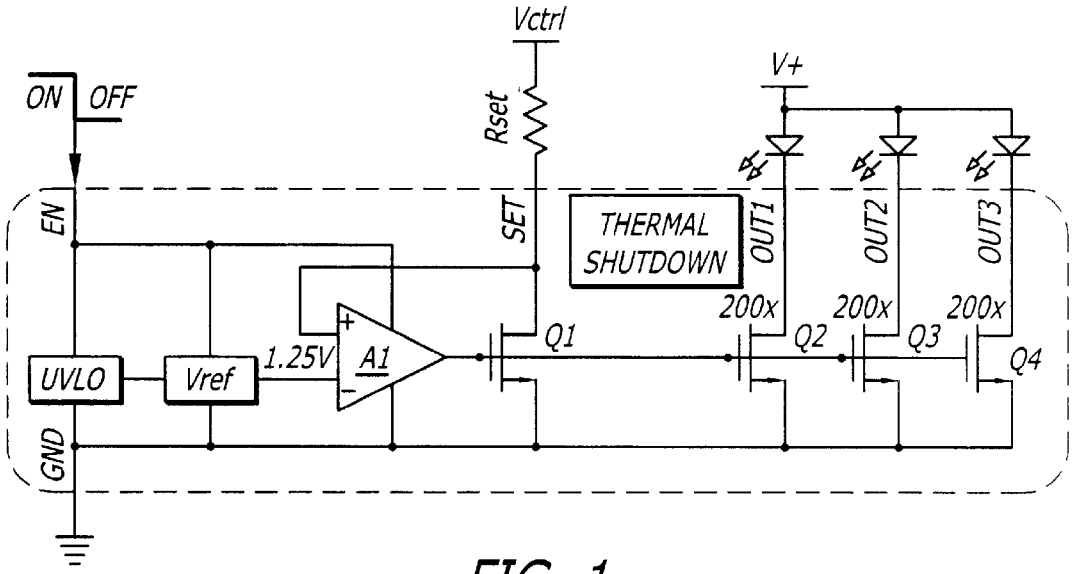
FIG. 1 is a diagram of an exemplary embodiment of the present invention

Now referring to FIG. 1, a diagram of an exemplary embodiment of the present invention may be seen. The embodiment shown is intended for fabrication in integrated circuit form for driving up to three light emitting diodes LED1, LED2 and LED3. The integrated circuit includes an enable (EN) pin, a SET pin, LED connection pins OUT1, OUT2 and OUT3 and an integrated circuit ground GND.

In the exemplary embodiment, the integrated circuit itself requires very little power, and accordingly, power for the circuit is provided by the enable signal on the enable pin EN. When the voltage on the enable pin EN goes high (typically to the system battery voltage or approaching the system battery voltage), the reference voltage generator Vref provides a reference voltage to an amplifier A1, in the specific exemplary embodiment shown, a 1.25 volt reference voltage. In the event, however, that the enable signal on the enable pin EN is below a predetermined voltage, namely a predetermined voltage below which the circuit is to be operated, an undervoltage lockout circuit UVLO will detect the undervoltage condition and disable the voltage reference generator Vref.

The positive input to amplifier A1 is taken from the drain of transistor Q1 which is connected to an external control voltage Vctrl through a user selectable external resistor Rset. Amplifier A1, therefore, drives the voltage on the gate of transistor Q1 to a level such that the drain voltage of transistor Q1 equals the output of the reference voltage generator Vref, in the specific exemplary embodiment being described, 1.25 volts. Thus the effect of the amplifier is to hold the voltage across transistor Q1, source to drain, to a predetermined voltage, 1.25 volts in the exemplary embodiment. This is to be compared to simply using a current mirror to mirror a current through a resistor coupled to an external regulated voltage to the transistors coupled to the LEDs. With such a current mirror alone, the resistor current and thus the LED current, as well as the LED drive transistor headroom, would be highly dependent on the threshold of the transistors, which has a substantial processing variation.

Since amplifier A1 has a very high input impedance, the drain current of transistor Q1 will be equal to $$\frac{Vctrl - Vref}{Rset}.$$

In a typical application, the control voltage Vctrl may use an existing regulated power supply elsewhere in the system in which the present invention is being used.

The output of amplifier A1 is also used to drive the gates of transistors Q2, Q3 and Q4. These transistors are preferably substantially larger than transistor Q1, transistor Q1 only being used to establish the gate voltage for transistors Q2, Q3 and Q4, while these latter transistors are each sized to conduct the LED current of the LED connected thereto. In the preferred embodiment, transistors Q2, Q3 and Q4 are approximately 200 times the size of transistor Q1. Thus the current through transistor Q1 is mirrored to each of transistors Q2, Q3 and Q4 in a ratio of 200:1, at least for those devices to which an LED is connected. In that regard, while the exemplary embodiment may be used to drive three LEDs, any lesser number may be used, as any transistor having an open drain will neither draw power nor otherwise affect the operation of the rest of the circuit. The circuit of FIG. 1 further includes a thermal shutdown circuit of a type well known in the prior art, which will shutdown the circuit to turn off transistors Q2 through Q4 in the event the circuit is subject to an excessive temperature, internally generated or otherwise.

When the voltage on the enable pin EN is low, the integrated circuit is disabled and transistors Q1 through Q4 are turned off, providing a high impedance on the terminals SET, OUT1, OUT2 and OUT3, allowing any external circuitry connected thereto to pull the respective pin high without power dissipation.

Figure 2:
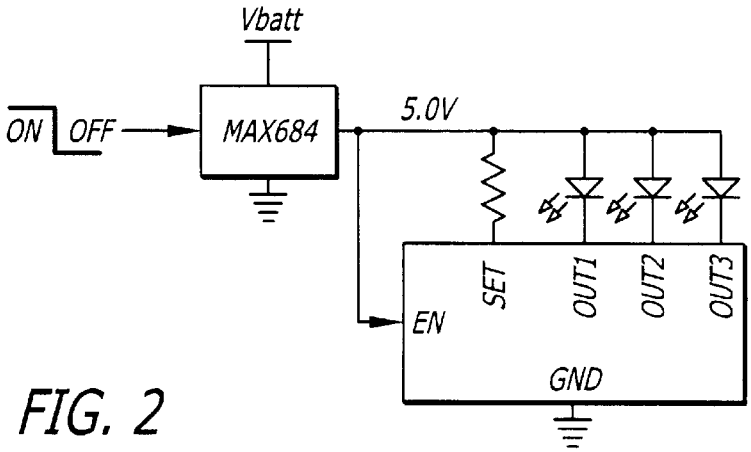
FIG. 2 is a diagram showing first exemplary application of the present invention.

In a typical application, the LEDs are supplied and turned on and off by a regulated charge pump, such as the MAX682/3/4, manufactured by Maxim Integrated Products, Inc., the assignee of the present invention. Also, the preferred embodiments of the present invention are used with white LEDs. Due to the typically high forward conduction voltage of white LEDs, the charge pump is used to provide enough voltage headroom such that the LEDs will maintain constant brightness for any battery voltage. When the charge pump is on, the LEDs are on, and when the charge pump is off, the LEDs are off. The charge pump's regulated output may also be used as the control voltage Vctrl. The use of the MAX682/3/4, which is a 3.3 volt input to a regulated 5 volt output charge pump, is exemplary only, and presented only as an illustration of one application of the present invention. Such an application is shown in FIG. 2. In a typical application, the MAX682/3/4 would also be supplying other circuits in the system. Preferably at least a 4 volt to 5.5 volt regulated supply is used in order to provide enough voltage headroom such that the LEDs will maintain constant brightness for any battery voltage.

Figure 3:
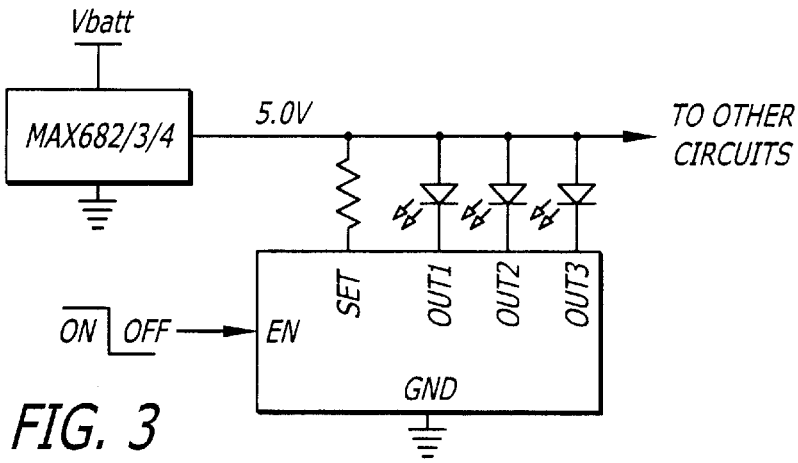
FIG. 3 is a diagram showing second exemplary application of the present invention.

An alternate application of the present invention may be seen in FIG. 3. This application is substantially the same as in FIG. 2, though with the enable pin EN is brought out separately for control independent of the presence of the 5 volt output of the MAX682/3/4.

Figure 4:
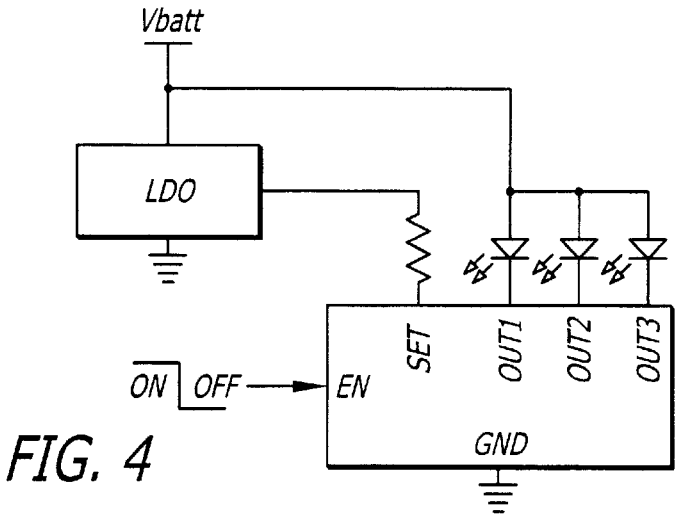
FIG. 4 is a diagram showing third exemplary application of the present invention.

For a particularly low cost application, the LEDs may be supplied directly from a battery, such as either a single lithium ion cell or three NiMH (nickel metal halide) cells, as shown in FIG. 4. Due to the typically high forward voltage of white LEDs, the LED brightness may slightly dim at the end of battery life. However, the present invention's current regulated architecture and low dropout will greatly minimize this effect compared to using a simple ballast resistor for each LED. A regulated supply, typically already existing in the system in which the present invention is used, such as from an LDO, is used in this application to provide the control voltage Vctrl.

Figure 5:
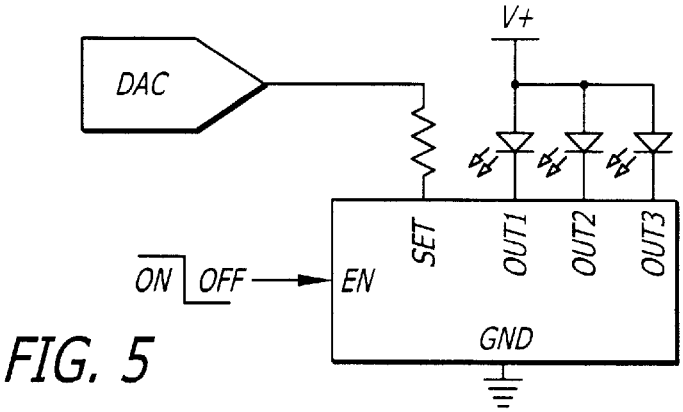
FIG. 5 is a diagram showing fourth exemplary application of the present invention.

FIG. 5 illustrates a further alternate application of an exemplary embodiment of the present invention wherein a voltage output digital-to-analog converter (DAC) is used to provide the control voltage Vctrl such that the LED brightness may be factory calibrated, or dynamically adjusted in the field. Alternatively, a current output DAC may be used in order to eliminate the current setting resistor Rset. In this application, the LEDs may be supplied directly from the battery (single lithium ion or three NiMH cells) or from a regulated supply. As shown, the LEDs may be turned on and off using the enable pin EN rather than using the DAC in order to minimize supply current and leakage for longer battery life.

There has been disclosed herein a method and apparatus for biasing of a light emitting diode, such as but not limited to, a white diode with a current source such that the current through the diode and its brightness are significantly less dependent upon the forward voltage drop of the diode than in prior art circuits. While a specific exemplary embodiment and various exemplary applications of that embodiment have been disclosed, such disclosure has been for purposes of illustration only and not by way of limitation. Accordingly, while these specific embodiments have been disclosed in detail herein, it will be understood by those skilled in the art that various changes in form and detail may be made therein without departing from the spirit and scope of the invention as defined by the following claims, giving the full scope thereto.

What is claimed is:

1. A current source bias circuit for light emitting diodes comprising:

an integrated circuit having a reference voltage generator, a differential amplifier and a plurality of transistors, the transistors each having first and second terminals and a control terminal, the current between the first and second terminals being controlled by the voltage between the control terminal and the first terminal, the first terminals of the plurality of transistors being coupled together and to a power supply terminal, the inputs to the differential amplifier being coupled to the reference voltage generator and only the second terminal of the first transistor of the plurality of transistors, the output of the differential amplifier being coupled to the control terminals of the plurality of transistors, and a resistor being connected to the second terminal of the first transistor.

2. The current source bias circuit of claim 1 wherein the first of the plurality of transistors is smaller than the rest of the plurality of transistors.

3. The current source bias circuit of claim 1 wherein the plurality of transistors are MOS transistors.

4. The current source bias circuit of claim 1 wherein the plurality of transistors are n-channel MOS transistors.

5. The current source bias circuit of claim 1 wherein the integrated circuit comprises an undervoltage lockout circuit.

6. The current source bias circuit of claim 1 wherein the integrated circuit comprises a thermal shutdown circuit.

7. The current source bias circuit of claim 1 wherein the integrated circuit is powered through an enable terminal.

8. The current source bias circuit of claim 1 wherein the plurality of transistors are n-channel MOS transistors, the integrated circuit comprises an undervoltage lockout circuit and a thermal shutdown circuit, and is powered through an enable terminal.

9. A current source bias circuit comprising:

an integrated circuit having a plurality of transistors, the transistors each having first and second terminals and a control terminal, the current between the first and second terminals being controlled by the voltage between the control terminal and the first terminal, and circuitry connecting the first terminals and the control terminals of the plurality of transistors so that the transistors are connected as a current mirror while holding only the second terminal of the first transistor of the plurality of transistors at a predetermined voltage relative to its first terminal.

10. The current source bias circuit of claim 9 wherein the first of the plurality of transistors is smaller than the rest of the plurality of transistors.

11. The current source bias circuit of claim 9 wherein the plurality of transistors are MOS transistors.

12. The current source bias circuit of claim 9 wherein the plurality of transistors are n-channel MOS transistors.

13. The current source bias circuit of claim 9 wherein the integrated circuit comprises an undervoltage lockout circuit.

14. The current source bias circuit of claim 9 wherein the integrated circuit comprises a thermal shutdown circuit.

15. The current source bias circuit of claim 9 wherein the integrated circuit is powered through an enable terminal.

16. The current source bias circuit of claim 9 wherein the plurality of transistors are n-channel MOS transistors, the integrated circuit comprises an undervoltage lockout circuit and a thermal shutdown circuit, and the integrated circuit is powered through an enable terminal.

17. A method of biasing light emitting diodes comprising:

providing a predetermined current through a first transistor;

mirroring the current through the first transistor to at least one additional transistor while holding the voltage across only the first transistor to a predetermined value, each additional transistor being coupled in series with a light emitting diode.

18. The method of claim 17 wherein the at least one additional transistor is a plurality of transistors.

19. The method of claim 17 wherein the transistors are MOS transistors.

20. The method of claim 17 wherein the transistors are n-channel MOS transistors.

21. The method of claim 17 wherein the light emitting diodes are white light emitting diodes.

22. The method of claim 21 wherein the transistors are n-channel MOS transistors.

23. The method of claim 17 wherein the at least one additional transistor is a plurality of MOS transistors and the light emitting diodes are white light emitting diodes.

* * * * *